US007029081B1

(12) United States Patent
Imanaka et al.

(10) Patent No.: US 7,029,081 B1
(45) Date of Patent: Apr. 18, 2006

(54) HEAD SUBSTRATE HAVING DATA MEMORY, PRINTING HEAD, PRINTING APPARATUS AND PRODUCING METHOD THEREFOR

(75) Inventors: Yoshiyuki Imanaka, Kawasaki (JP); Masahiko Ogawa, Hino (JP); Ichiro Saito, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/426,896

(22) Filed: Oct. 26, 1999

(30) Foreign Application Priority Data

Oct. 27, 1998 (JP) ..... 10-306179
Oct. 27, 1998 (JP) ..... 10-306182

(51) Int. Cl.
*B41L 29/38* (2006.01)

(52) U.S. Cl. ..... 347/5; 347/9; 347/12; 347/15

(58) Field of Classification Search ..... 347/9, 347/12, 15, 10, 13, 5
See application file for complete search history.

(56) References Cited

U.S. PATENT DOCUMENTS 5,172,134 A * 12/1992 Kishida et al. ..... 347/13
5,363,134 A 11/1994 Barbehenn et al. ..... 347/49
5,365,312 A 11/1994 Hillmann et al. ..... 355/206
5,504,507 A 4/1996 Watrobski et al. ..... 347/19
6,318,828 B1 * 11/2001 Barbour et al. ..... 347/9
2002/0140751 A1 * 10/2002 Imanaka et al. ..... 347/9

FOREIGN PATENT DOCUMENTS

EP 571093 4/1993
JP 08-177732 7/1996

OTHER PUBLICATIONS

Database WPI (Abstract of JP 08-156257)—Jun. 18, 1996.

* cited by examiner

*Primary Examiner*—Hai Pham
*Assistant Examiner*—Lam S Nguyen
(74) *Attorney, Agent, or Firm*—Fitzpatrick, Cella, Harper & Scinto

(57) ABSTRACT

There is disclosed a head substrate of a printing head detachably mounted on a printer main body, comprising plural external connection terminals individually receiving, from the exterior, a binary logic signal corresponding to whether or not to execute a recording operation, a recording image signal and a clock signal, recording execution means for executing the recording operation according to the recording image signal and the clock signal entered through the external connection terminals, in case the binary logic signal is in a first state, data memory means for and data readout, and memory access means for recognizing the binary logic signal in a second state as an access permission signal and executing the memory access to the data memory means at a timing corresponding to the clock signal when the logic signal is a second state.

22 Claims, 12 Drawing Sheets

HEAD SUBSTRATE HAVING DATA MEMORY, PRINTING HEAD, PRINTING APPARATUS AND PRODUCING METHOD THEREFOR

BACKGROUND OF THE INVENTION

1. Field of the Invention

The present invention relates to a head substrate provided with recording execution means for executing recording according to recording data and memory means for storing various data, a printing head utilizing such head substrate, and a printing apparatus utilizing such printing head.

2. Related Background Art

There are already commercialized various printing apparatuses, including such an apparatus having a replaceable printing head as an ink jet printer. As an example, in the ink jet printer, plural external connection terminals are provided in a printer main body and a printing head, and these terminals are mutually connected when the printing head is mounted on the printer main body.

In such state, the printer main body can transfer various signals such as a recording image signal and a recording clock signal to the printing head, so that the printing head can execute the recording of the externally entered image signal at a timing corresponding to the recording clock signal.

In such printer apparatus with the replaceable printing head, it is now proposed to provide a printing head with various data such as ID (identification) data of the head in readable manner. For this purpose, it is proposed to provide a printing head with data memory means such as ROM (read only memory), as disclosed in the Japanese Patent Application Laid-Open Nos. 3-126560 and 8-177732 and the U.S. Pat. Nos. 5,504,507 and 5,363,134.

This type of printing head can be interchangeable mounted on the printer main body and can also store various data by the data memory means in arbitrarily readable manner.

However, in case the printing head is provided with the data memory means such as ROM, it is necessary to provide the printing head and the printer main body with exclusive plural connection terminals for executing the access to the memory. Such configuration increases the dimension of the external connection terminals in the printing head and in the printer main body, with a loss in the productivity thereof.

Also in case various signals are used commonly for the recording operation and the data writing/reading in/from the memory, data may be written by a noise generated in the course of the recording operation. In such case, the stored data are overwritten by the noise so that an error is generated in the data readout.

SUMMARY OF THE INVENTION

In consideration of the foregoing, a first object of the present invention is to provide a head substrate capable of executing the recording operation and the memory access while minimizing the increase in the external connection terminals in the presence of the data memory means, a printing head utilizing such head substrate and a printer apparatus utilizing-such printing head.

A second object of the present invention is to provide a head substrate capable of avoiding unnecessary overwriting of the data stored in the data memory means even in case various signals are used in common for the recording operation and the data readout, a printing head utilizing such head substrate and a printer apparatus utilizing such printing head.

The above-described objects can be attained, according to the principal configuration and the method of the present invention, by a head substrate for the printing head, comprising plural external connection terminals for externally and individually entering a binary logic signal indicating whether the recording operation is executed or not, a recording image signal and a clock signal; recording execution means for executing a recording operation according to the recording image signal and the clock signal entered through the external connection terminals in case the binary logic signal is in a first state; data memory means for executing a memory access which is at least either of data writing and data readout; and memory access means for recognizing the binary logic signal as an access permission signal and executing the memory access to the data memory means in a timing corresponding to the clock signal when said logic signal is in a second state.

According to the present invention, there is also provided a printing apparatus utilizing the above-mentioned printing head.

There is also provided a head substrate, comprising plural external connection terminals for externally entering various signals and driving electric power; recording execution means for executing a recording operation corresponding to the signals and the electric power externally entered into the external connection terminals; data memory means enabling execution of data writing and data readout; memory access means for executing data writing into the data memory means according to the signals and the driving electric power externally entered into the external connection terminals and also executing data readout according to the signals; and writing inhibition means for permanently disabling the data writing into the data memory means by the memory access means.

There is also provided a printing head utilizing the above-mentioned printing substrate.

There is also provided a printing head, comprising plural external connection terminals for externally and individually entering a binary logic signal indicating whether the recording operation is executed or not, a recording image signal and a clock signal; recording execution means for executing a recording operation according to the recording image signal and the clock signal entered through the external connection terminals in case the binary logic signal is in a first state; data memory means for executing a memory access which is at least either of data writing and data readout; and memory access means for recognizing the binary logic signal in a second state as an access permission signal and, in such second state, executing memory access to the data memory means in a timing corresponding to the clock signal.

There is also provided a printing head comprising plural external connection terminals for externally entering various signals and driving electric power; recording execution means for executing a recording operation corresponding to the signals and the electric power externally entered into the external connection terminals; data memory means enabling data readout; and memory access means for reading data stored in the data memory means, wherein the memory access means is rendered permanently incapable, by writing inhibition means, of data writing into the data memory means.

There is also provided a printer apparatus provided with the above-mentioned printing head.

There is also provided a method of producing a head substrate comprising a step of preparing a head substrate, including plural external connection terminals for externally entering various signals and driving electric power, recording execution means for executing a recording operation corresponding to the signals and the electric power externally entered into the external connection terminals, data memory means capable of execution of data writing and data readout, memory access means for executing data writing into the data memory means according to the signals and the driving electric power externally entered into the external connection terminals and also executing data readout according to the signals, and writing inhibition means for permanently disabling the data writing into the data memory means by the memory access means; a step of executing data writing into the data memory means by the memory access means; and a step of permanently disabling, after the data writing and by writing inhibition means, the data writing into the data memory means by the memory access means.

There is also provided a method of producing a printing head comprising a step of preparing a printing head including plural external connection terminals for externally entering various signals and driving electric power, recording execution means for executing a recording operation corresponding to the signals and the electric power externally entered into the external connection terminals, data memory means capable of execution of data writing and data readout, memory access means for executing data writing into the data memory means according to the signals and the driving electric power externally entered into the external connection terminals and also executing data readout according to the signals, and writing inhibition means for permanently disabling the data writing into the data memory means by the memory access means; a step of executing data writing into the data memory means by the memory access means; and a writing inhibition step of permanently disabling, after the data writing and by writing inhibition means, the data writing into the data memory means by the memory access means.

In the present invention, "recording and printing" mean not only providing a recording medium with a meaningful image such as a character or graphics but also providing an image without meaning such as a pattern.

Also the present invention is applicable to a printer for printing on various recording media such as paper, yarn, fibers, fabrics, leather, metal, plastics, glass, wood or ceramics, a copying apparatus, a facsimile apparatus having a communication system, a printer system consisting of combination of a communication system and a printer unit, a word processor having a printer unit, and an industrial recording apparatus combined with various processing units in complex manner.

Also the "head substrate" used herein does not indicate a substrate consisting of silicon semiconductor but indicates a substrate in which circuit (functional) elements and wirings are incorporated for example with deposition films through a semiconductor manufacturing process.

Also various means referred to in the present invention may be suitably so formed as to realize the desired functions, and include, for example, an exclusive hardware, a computer provided with appropriate functions by a program, functions realized within a computer by an appropriate program, and combinations thereof.

DESCRIPTION OF THE PREFERRED EMBODIMENTS

Figure 1:
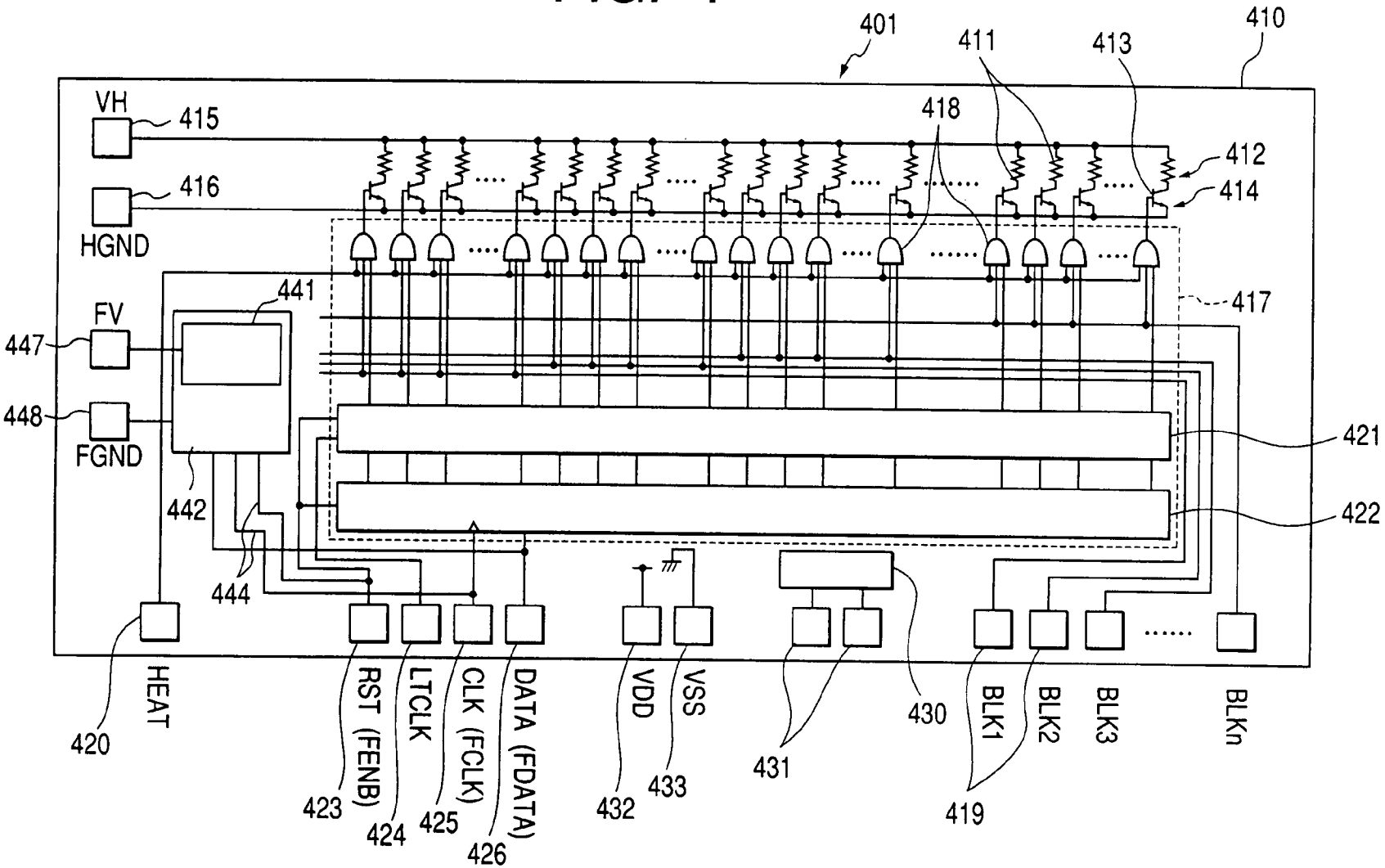
FIG. 1 is a block diagram showing the circuit configuration of the head substrate in an embodiment of the present invention.
Figure 2:
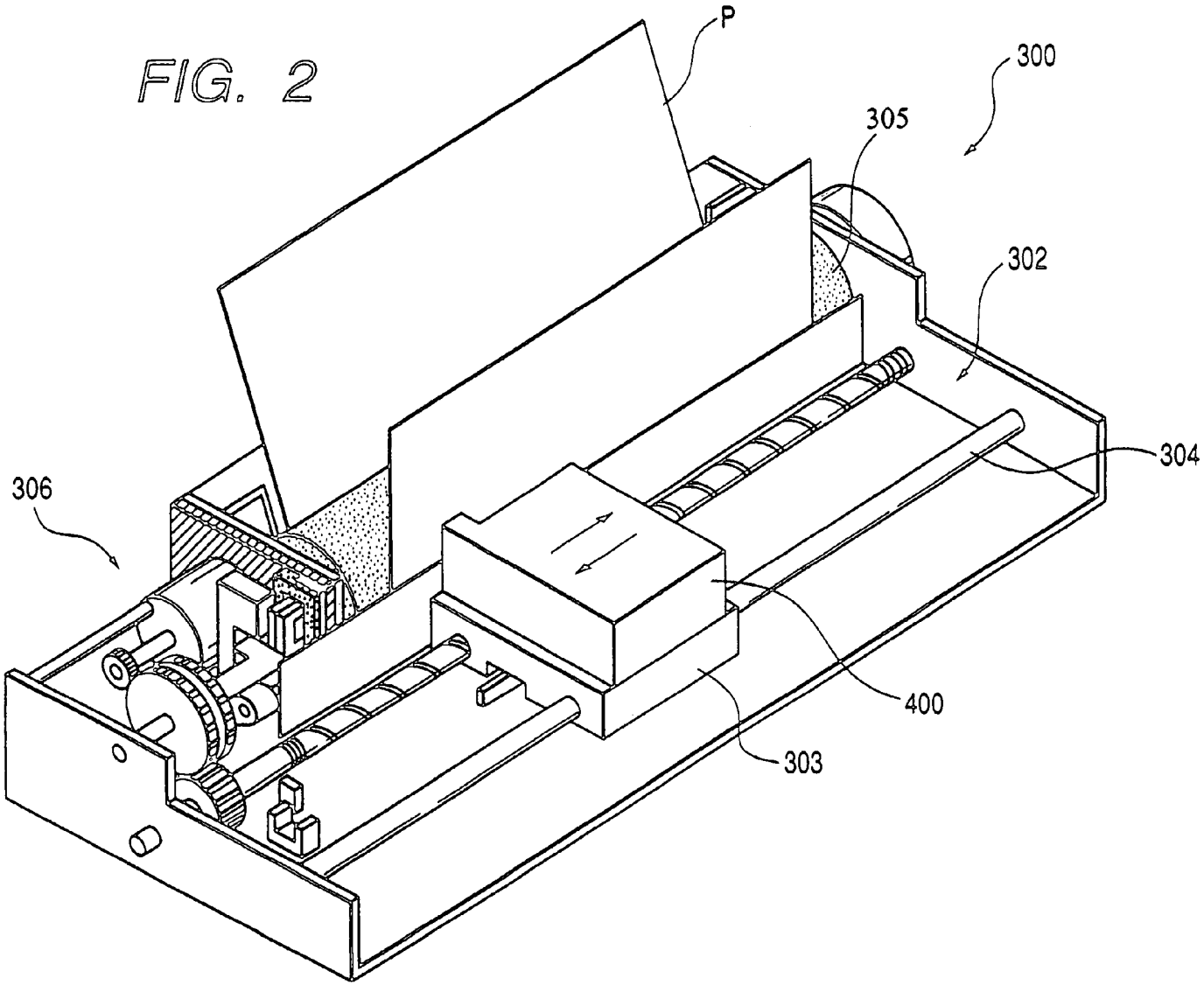
FIG. 2 is an external perspective view of a printer apparatus.
Figure 3:
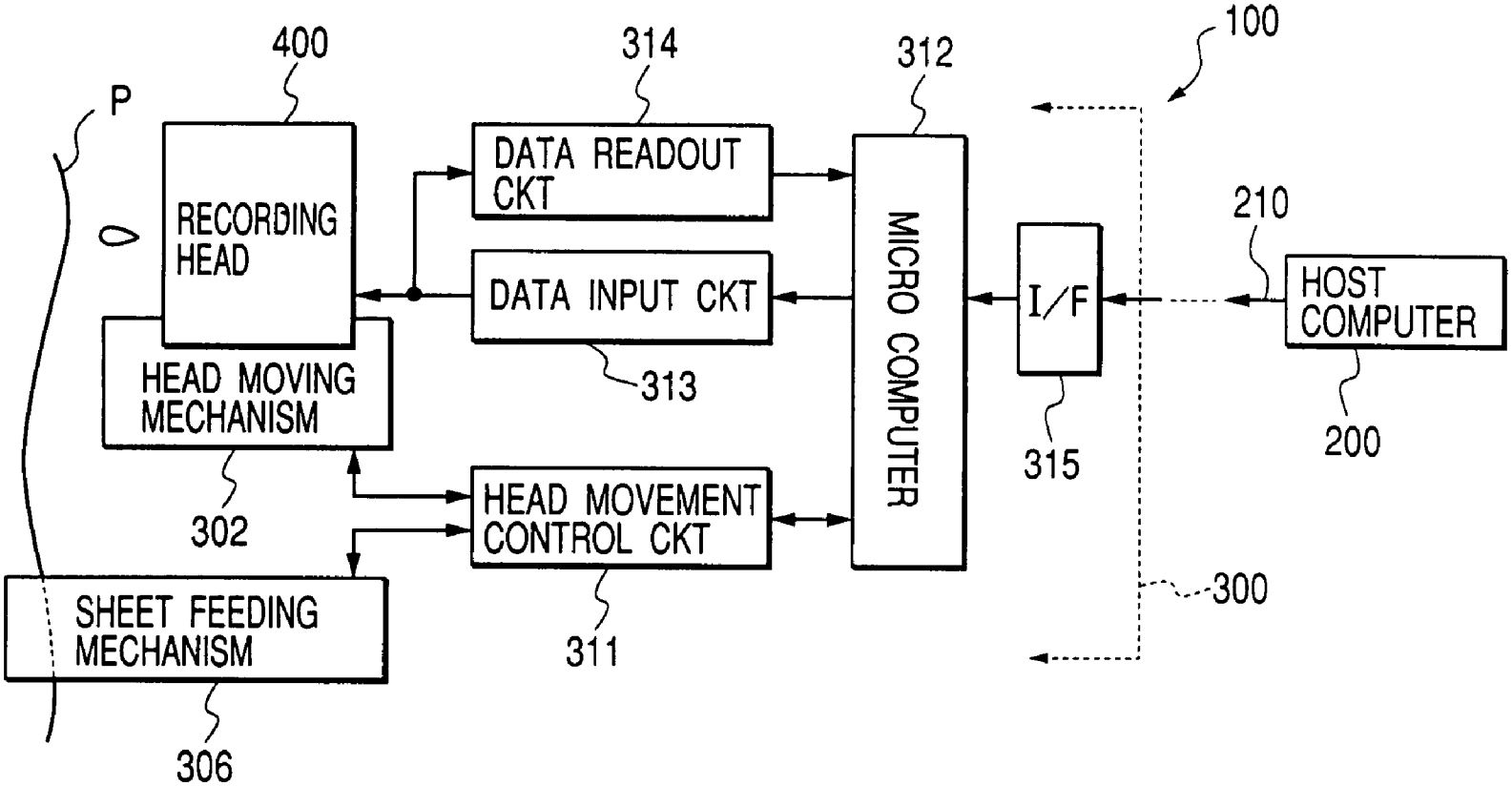
FIG. 3 is a schematic block diagram showing the circuit configuration of the printer apparatus.

An embodiment of the present invention will be explained in the following, with reference to the attached drawings, in which FIG. 1 is a block diagram showing the circuit configuration of the head substrate in an embodiment of the present invention; FIG. 2 is an external perspective view of a printer apparatus; FIG. 3 is a schematic block diagram showing the circuit configuration of the printer apparatus; and FIGS. 4 to 8 are block diagrams showing the circuit configuration in variations of the head substrate.

As shown in FIG. 3, an image processing system 100 of the present embodiment is provided with a host computer 200 constituting a central processing unit and an ink jet printer 300 constituting a printing apparatus, which are connected through a communication cable 210.

The ink jet printer 300 of the present embodiment is provided, as shown in FIG. 2, with a recording head 400, which is composed of a head substrate 401 and a cover member (not shown). As shown in FIG. 1, the head substrate 401 is provided with a base substrate 410, on which various elements and circuit are formed with films and others.

In the head substrate 401 of the present embodiment, the front edge portion of the surface of the base substrate 410 bears plural heater elements (heat generating elements) 411, constituting a heater portion 412. Ends of the plural heater elements 411 are electrically connected respectively to the source electrodes of plural power transistors 413, which constitute a driver circuit 414.

The other ends of the plural heater elements 411 and the drain electrodes of the plural power transistors 413 are electrically connected to a pair of heater power supply terminals 415, 416 constituting the external connection terminals and the gate electrodes of the plural power transistors 413 are electrically connected respectively to plural AND gates 418 of a heater logic circuit 417. The heater logic circuit 417, the driver circuit 414 and the heater unit 412 constitute recording execution means.

The heater element 411 is composed of a film for example of tantalum nitride, tantalum-aluminum, tantalum-silicon nitride etc. and generates heat by a driving electric power supplied from the driver circuit 414 through the heater power supply terminals 415, 416.

These plural AND gates 418 are matrix wired in plural control blocks, and plural block terminals 419 constituting the external connection terminals are connected to the plural AND gates 418 in each block. Also the plural AND gates 418 are connected to a pulse terminal 420 which is an external connection terminal, and to a latch circuit 421 which is connected in parallel to a shift register 422.

The latch circuit 421 and the shift register 422 are connected in common to a reset terminal 423 constituting an external connection terminal, and also respectively connected to clock terminals 424, 425 constituting also the external connection terminals. The shift register 422 is also connected to a data terminal 426, which constitutes another external connection terminal.

The block terminal 419 receives a selection signal for selecting the plural control blocks of the plural heater elements 411, while the pulse terminal 420 receives a recording pulse signal for controlling the heat generating time of the heater element 411. The reset terminal 423 receives a reset signal, for resetting the latch circuit 421 and the shift register 422, as a binary logic signal corresponding to presence or absence of the recording operation (whether or not to execute the recording operation).

The clock terminal 424 receives a latch signal for controlling the data latching operation of the latch circuit 421, and the clock terminal 425 receives a printing clock signal for determining the frequency of data shifting in the shift register 422.

The data terminal 426 receives a serial image signal, which is converted into by the shift register 422 into a parallel signal, which is temporarily held by the latch circuit 421 and is supplied through the AND gages 418 to the driver circuit 414, whereby the plural heater elements 411 generate heat corresponding the recording control signal.

On the base substrate 410, there is also formed a sensor unit 430 composed of a temperature sensor and a temperature holding sensor, and the sensor unit 430 is connected to a pair of sensor terminals 431 constituting the external connection terminals. The external connection terminals also include a pair of power supply terminal 432, 433 which are connected to various units.

The sensor unit 430 executes heating (for heat-retaining) of the base substrate 410 and measurement of temperature thereof, and the sensor terminal 431 receives a control signal for the sensor unit 430. Power supply terminals 432, 433 receive the driving electric power to be supplied to various units, including the heater logic circuit 417.

In the head substrate 401 of the present embodiment, there is formed a fuse ROM 441 as data memory means on the surface of the base substrate 410, and a fuse logic circuit 442 constituting memory access means is formed so as to surround the fuse ROM 441.

The fuse ROM 441 records various data such as the ID code of the printing head 400 and the function characteristics of the heater unit 412 prior to the shipment, and the heater logic circuit 442 executes memory access, including the data recording and the data readout, to the fuse ROM 441. The fuse ROM 441 in the present embodiment is provided with a memory capacity not exceeding 100 bits, since the data to be stored therein are the ID code and the function characteristics as explained above.

In the printing head 400 of the present embodiment, the fuse logic circuit 442 is connected in common to the aforementioned external connection terminals 423, 425, 426 connected to the recording logic circuit 417, through a signal wiring 444 constituting common terminal wiring means.

Consequently, the reset signal for the shift register 422 and the latch circuit 421, entered externally to the reset terminal 423, is also supplied to the fuse logic circuit 442 through the signal wiring 444, whereby the fuse logic circuit 442 recognizes the reset signal of a second state as an access permission signal.

Also the input signal for the shift register 422, entered externally to the clock terminal 425, is supplied as a memory clock signal to the fuse logic circuit 442, whereby the data read therefrom are serially transferred through a signal wiring 446 to the data terminal 426.

The fuse logic circuit 442, being enabled for memory access to the fuse ROM 441 upon recognizing the access permission signal as explained above, reads the data stored in the fuse ROM 441 if the memory clock signal is externally entered in this state.

The fuse logic circuit 442 is also connected to a pair of memory power supply terminals 447, 448 constituting external connection terminals, and the fuse logic circuit 442 executes the memory access by the driving electric power supplied through these terminals 447, 448.

In the recording head including the head substrate 401 of the present embodiment, a sealing member constituting partitions of a predetermined shape and a cover member consisting of a cover substrate are adhered to the surface of the head substrate 401 to form, on the surface of the head substrate 401, nozzles corresponding to the heater elements, ink supply paths and an ink holding portion (not shown) including ink reservoirs, by the partitions of the sealing member.

In the ink jet printer 300 of the present embodiment, the recording head 400 of the above-described configuration is detachably mounted, as shown in FIG. 2, on a carriage 303 of a head moving mechanism 302, and the carriage 303 is supported movably in the main scanning direction, for example by a guide shaft 304.

The recording head 400 is provided with the plural external connection terminals 415, . . . as explained in the foregoing, and plural external connection terminals (not shown) of an corresponding arrangement are also provided on the carriage 303. Therefore, when the recording head 400 is mounted on the carriage 303, the plural external connection terminals 415, . . . of the recording head 400 are respectively connected to those of the carriage 303.

In a position opposed to the recording head 400 mounted on the carriage 303, there is provided a platen roller 305 for supporting and conveying a recording sheet P constituting the recording medium, and the platen roller 305, etc. constitute a sheet feeding mechanism 306 for conveying the recording sheet P in successive manner in the sub scanning direction.

The head moving mechanism 302 and the sheet feeding mechanism 306 are connected to a movement control circuit 311, which is in turn connected to a microcomputer 312. The microcomputer 312 comprehensively controls the head moving mechanism 302 and the sheet feeding mechanism 306, thus constituting relative movement means for causing the surface of the recording sheet P to move relative to the ink discharging position of the recording head 400.

The microcomputer 312 is also connected to a data input circuit 313 constituting recording input means, a data readout circuit 314 constituting access control means, a communication I/F 315, etc., and the host computer 200 is connected to the communication I/F 315 through the communication cable 210.

The data input circuit 313 is connected to the heater logic circuit 417 of the recording head 400 through the carriage 303, and the data readout circuit 314 is connected to the fuse logic circuit 442 of the recording head 400 through a connector of the carriage 303.

At the execution of image recording, the data input circuit 313 supplies the heater logic circuit 417 of the recording head 400 with a recording image signal, and, at the execution of memory access, the data readout circuit 314 reads the stored data of the fuse ROM 441 from the fuse logic circuit 442 of the recording head 400.

Figure 4:
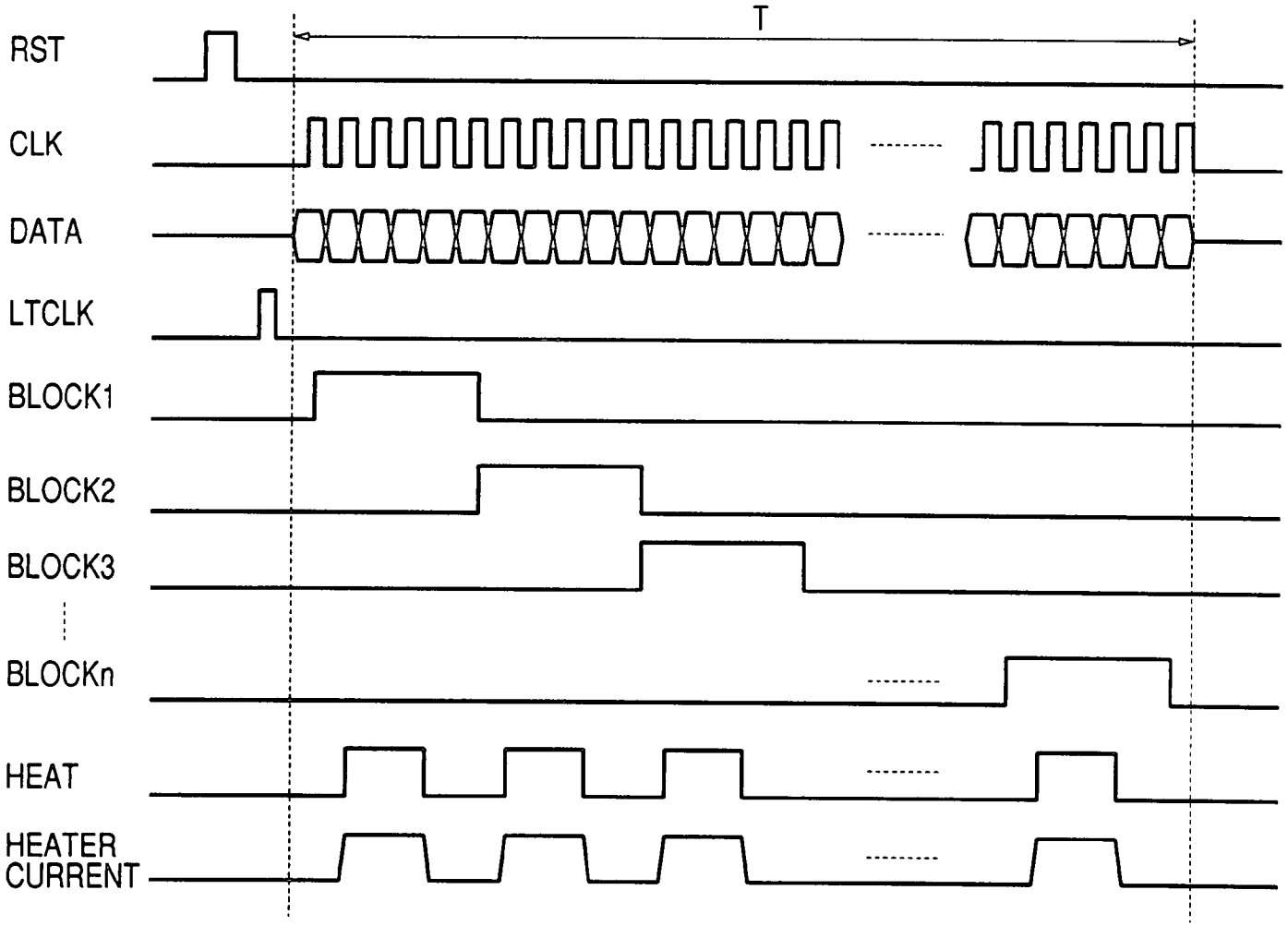
FIGS. 4 and 5 are charts showing drive signals.
Figure 5:
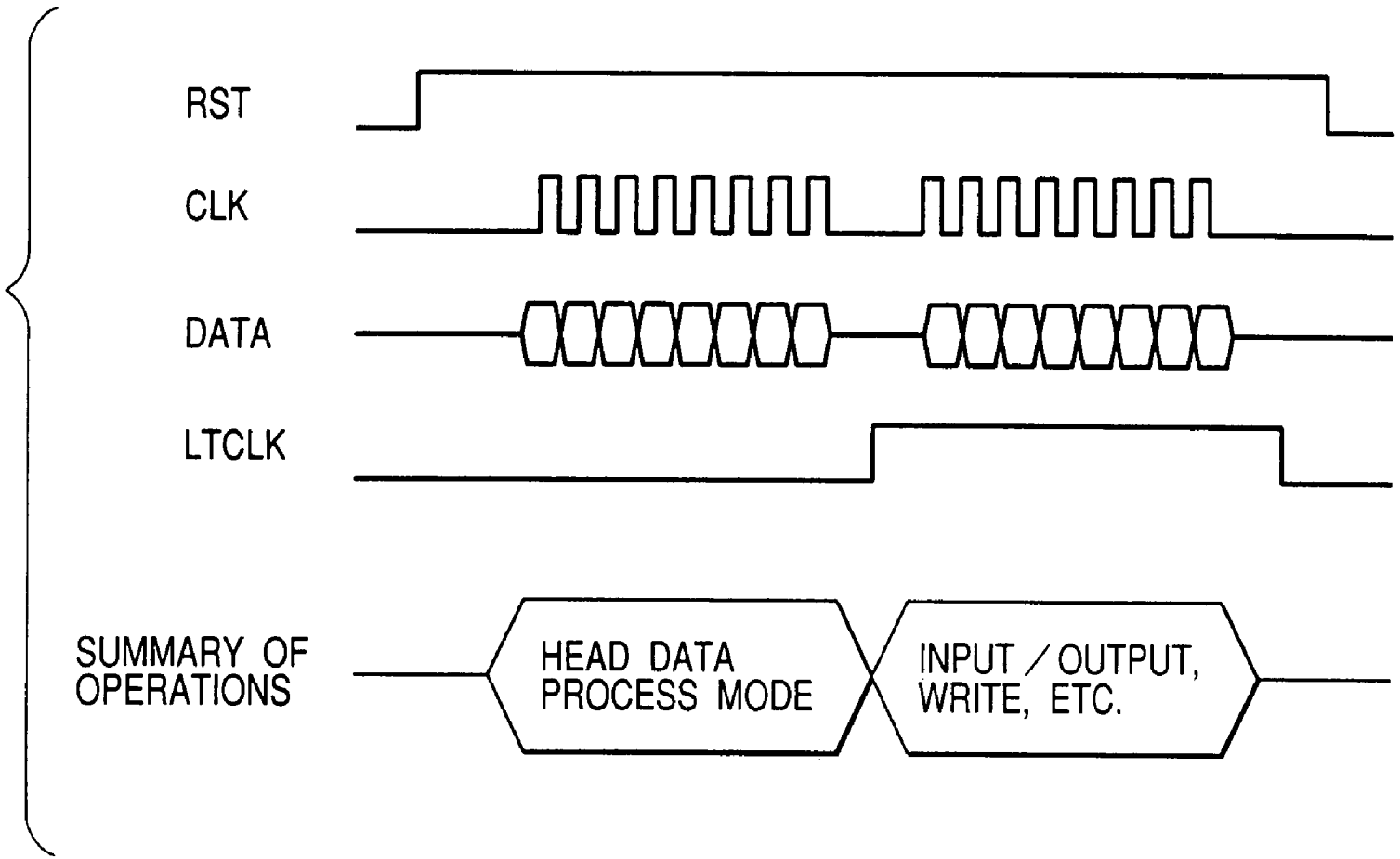

For more detailed explanation, various signals are shown in timing charts shown in FIGS. 4 and 5.

The data input circuit 313 retains the reset signal at the first (low) state as shown in FIG. 4 at the execution of the image recording, and individually transmits the recording image signal and the recording clock signal thereby causing the heater logic circuit 417 etc. to execute the recording operation. Thus this first state corresponds to a state in which the recording operation is executed. In this period (T in FIG. 4), the heater control signals (for example HEAT and BLOCK) vary the state, but the reset signal (RST) and the latch signal (LTCLK) are not varied in the logic state.

On the other hand, the data readout circuit 314 retains, at the execution of memory access, the reset signal at the second (high) state (cf. FIG. 5) and transmits the memory clock signal, and serially receives the readout data serially transferred in synchronization therewith from the fuse logic circuit 442.

When the reset signal is shifted to the high state, the shift register 422 and the latch circuit 421 are retained in a continued reset state, whereby the recording operation is not executed even if various signals are exchanged through the external connection terminals in such memory access state. As the fuse logic circuit 442 executes the memory access only when the memory clock signal is entered in the high state of the reset signal, the memory access is not executed during the execution of the recording operation.

In the present embodiment shown in FIG. 5, the reset signal is used for switching the recording operation and the memory access, but there may also be employed any other signal such as the latch signal (LTCLK) that does not change the logic state at the transfer of the recording signal. In the embodiment shown in FIG. 5, the reset signal is used for switching the recording operation and the memory access, while the latch signal is used for switching a head data processing mode and a process for data input/output and data writing.

The microcomputer 312 comprehensively controls the circuits 311, 313 and 314, thereby supplying the recording image signal, entered from the host computer 200 to the communication I/F 315, to the data input circuit 313 and outputs the data, read by the data readout circuit 314 from the recording head 400, to the host computer 200 through the communication I/F 315.

The ink jet printer 300 of the present embodiment is also provided with an ink tank (not shown) constituting ink supply means, and such ink tank is connected to the ink supporting portion of the recording head 400 through a socket member (not shown) of the carriage 303. The ink tank is filled in advance with liquid ink and supplies the printing head 400 with such ink.

In the image processing system 100 of the above-described configuration of the present embodiment, the host computer 200 supplies the ink jet printer 300 with the recording image signal, which is outputted by the ink jet printer 300 onto the recording sheet P.

In such operation, under the control by the microcomputer 312, the head moving mechanism 302 moves the recording head 400 in the main scanning direction, while the sheet feeding mechanism 306 moves the recording sheet P in the sub-scanning direction, and the data input circuit 313 enters the recording image signal into the printing head 400 in synchronization with these operations.

The recording head 400 supports, in the ink supporting portions, the ink constantly supplied from the ink tank, and the heater logic circuit 417 selectively drives the plural heater elements 411 according to the entered recording image signal. The liquid ink in the ink supporting portion generate bubbles by the selective heat generation of the plural heater elements (heat generating elements), whereby ink droplets are discharged and deposited onto the recording sheet P in relative movement, thereby forming a dot matrix image.

In the image processing system 100 of the present embodiment, the recording head 400 is provided with the fuse ROM 441, and the ID code and the function characteristics of the heater unit 412 are recorded in the fuse ROM 441 at a time after the manufacture of the recording head 400 and prior to the shipment thereof.

When the recording head 400, shipped after such data recording, is mounted in the ink jet printer 300, it is rendered capable, by the data readout circuit 314, of reading the stored data from the fuse ROM 441 of the recording head 400.

The ink jet printer 300 is therefore rendered possible to regulate the electric power supplied to the heater unit 412 according to the function characteristics thereof read from the fuse ROM 441 of the recording head 400 and to inform the host computer 200 of the ID code of the recording head 400.

Also in the ink jet printer 300 of the present embodiment, the printing head 400 is provided with the fuse ROM 441 as explained in the foregoing, but the signals for access to such memory are entered by the external connection terminals 423, 425, 426 used for the recording operation.

In such configuration, it is not required to provide the printing head 400 with the additional terminals exclusive for the access to the fuse ROM 441, thereby allowing to reduce the dimension and weight of the printing head 400 and to improve the production capability thereof. Similarly it is not required to provide the carriage 300 with the additional terminals, so that the ink jet printer 300 can be realized compacter and lighter with improved production capability.

As various signals in the recording operation are utilized for the signals for memory access as explained in the foregoing, the data readout circuit 314 and the data input circuit 313 can be formed in common in a large proportion of the hardware in the ink jet printer 300, whereby the ink jet printer 300 can be simpler in structure and smaller in dimension and weight.

The present invention is limited to the foregoing embodiment but includes various modifications within the scope of technical concept of the present invention. For example, the foregoing embodiment has shown an ink jet printer of electrothermal conversion type, but the present invention is applicable to the printer apparatus of various types in which the printing head is replaceable.

Also in the foregoing embodiment, the ink jet printer 300 and the printing head 400 utilize a data terminal 426 for serially transferring the recording image signal and the data read from the fuse ROM 441, but these may be transferred in parallel through plural external connection terminals.

Also in the foregoing embodiment, the fuse ROM 441 and the fuse logic circuit 442 are formed, together with the heater unit 412 and the heater logic circuit 417, on a single base substrate 410 with layered structure, but it is also possible to mount an independent chip constituting the fuse ROM 441 or the fuse logic circuit 442 on the base substrate 410. However, incorporation of these elements into a single base substrate enables further compactization and cost reduction.

Figure 6:
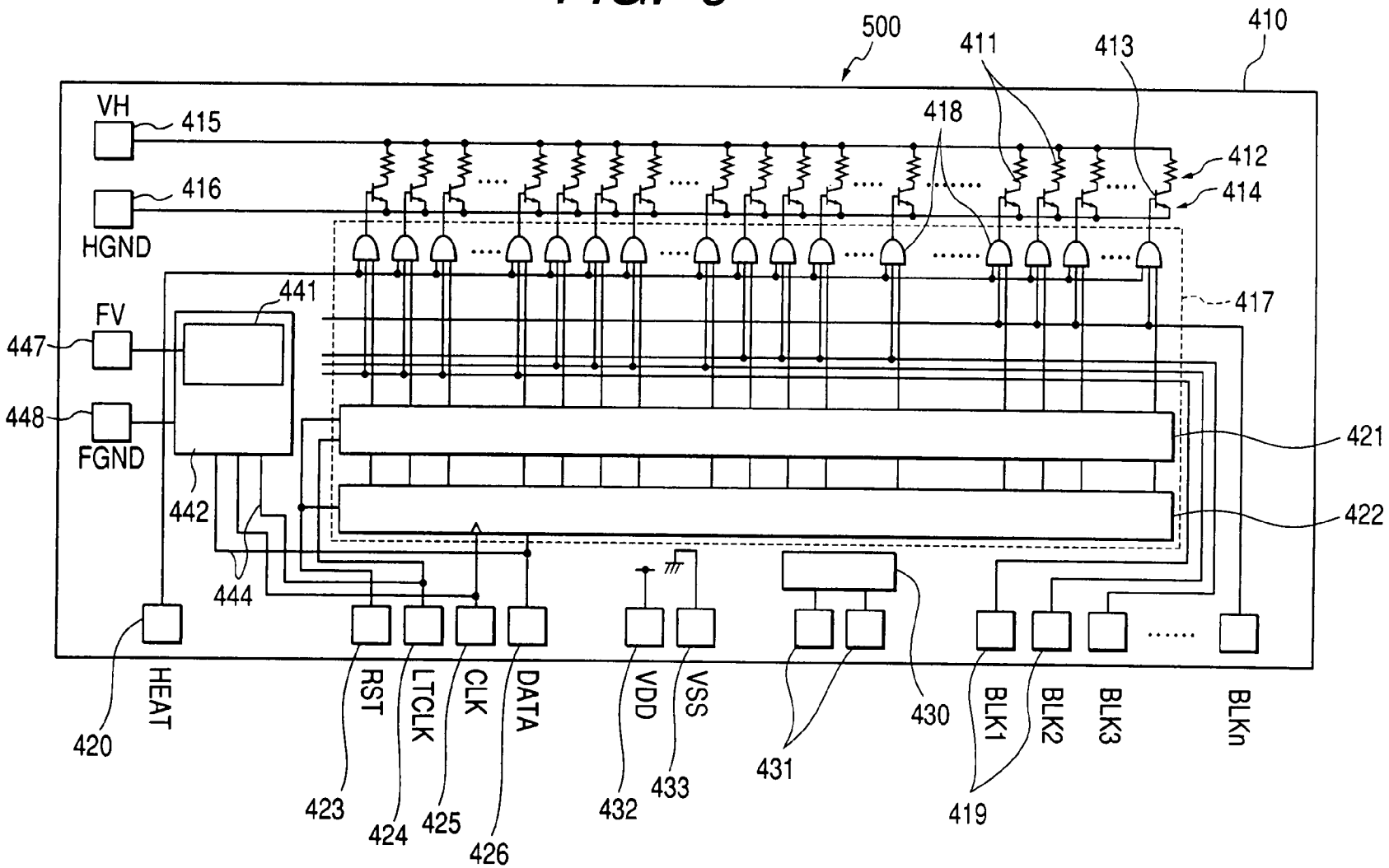
FIG. 6 is a block diagram showing the circuit configuration of a second variation of the head substrate.

Also in the foregoing embodiment, the reset signal for the shift register 422 and the latch circuit 421 is used as the access permission signal for the fuse logic circuit 442, but it is also possible, as in the case of a head substrate 500 shown in FIG. 6, to utilize the latch signal for the latch circuit 421, entered externally to the clock terminal 424, for this purpose.

Also in the foregoing embodiment, the shift register 422 and the latch circuit 421 utilize a reset signal in common, but there may be employed separate signals for this purpose, and, in such case either of such signals may be utilized as the access permission signal for the fuse logic circuit 442.

Also in the foregoing embodiment, the ink jet printer 300 causes the fuse logic circuit 442 to only execute the readout of the data stored in the fuse RPM 441, but it is also possible to execute the data writing or to selectively execute the data readout and the data writing.

Figure 7:
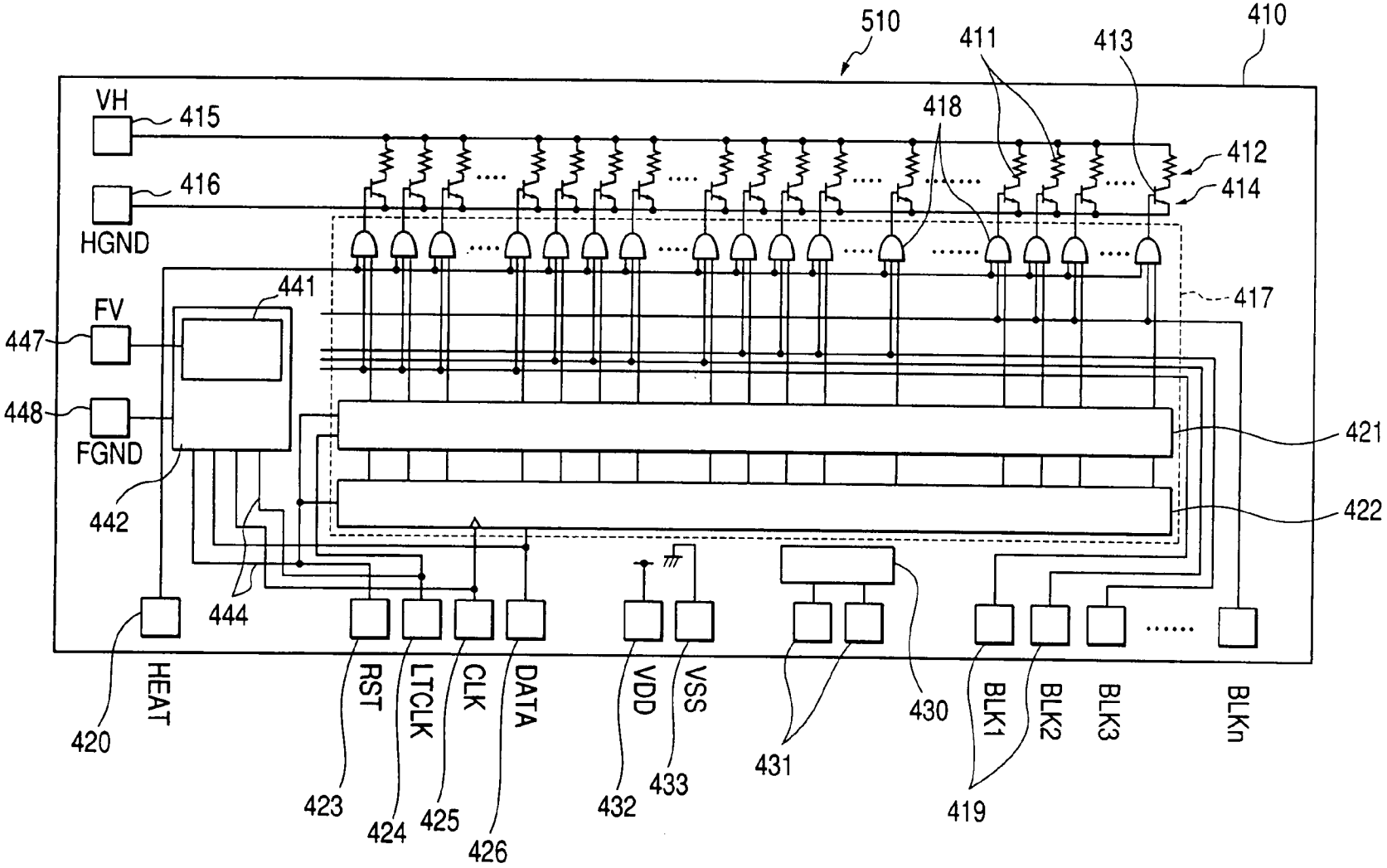
FIG. 7 is a block diagram showing the circuit configuration of a third variation of the head substrate.

However, if the content of the memory access is increased as explained above, there are required control signals therefor and it is preferable, as in the head substrate 510 shown in FIG. 7, to connect the fuse logic circuit 442 to four external connection terminals 423 to 426.

Figure 8:
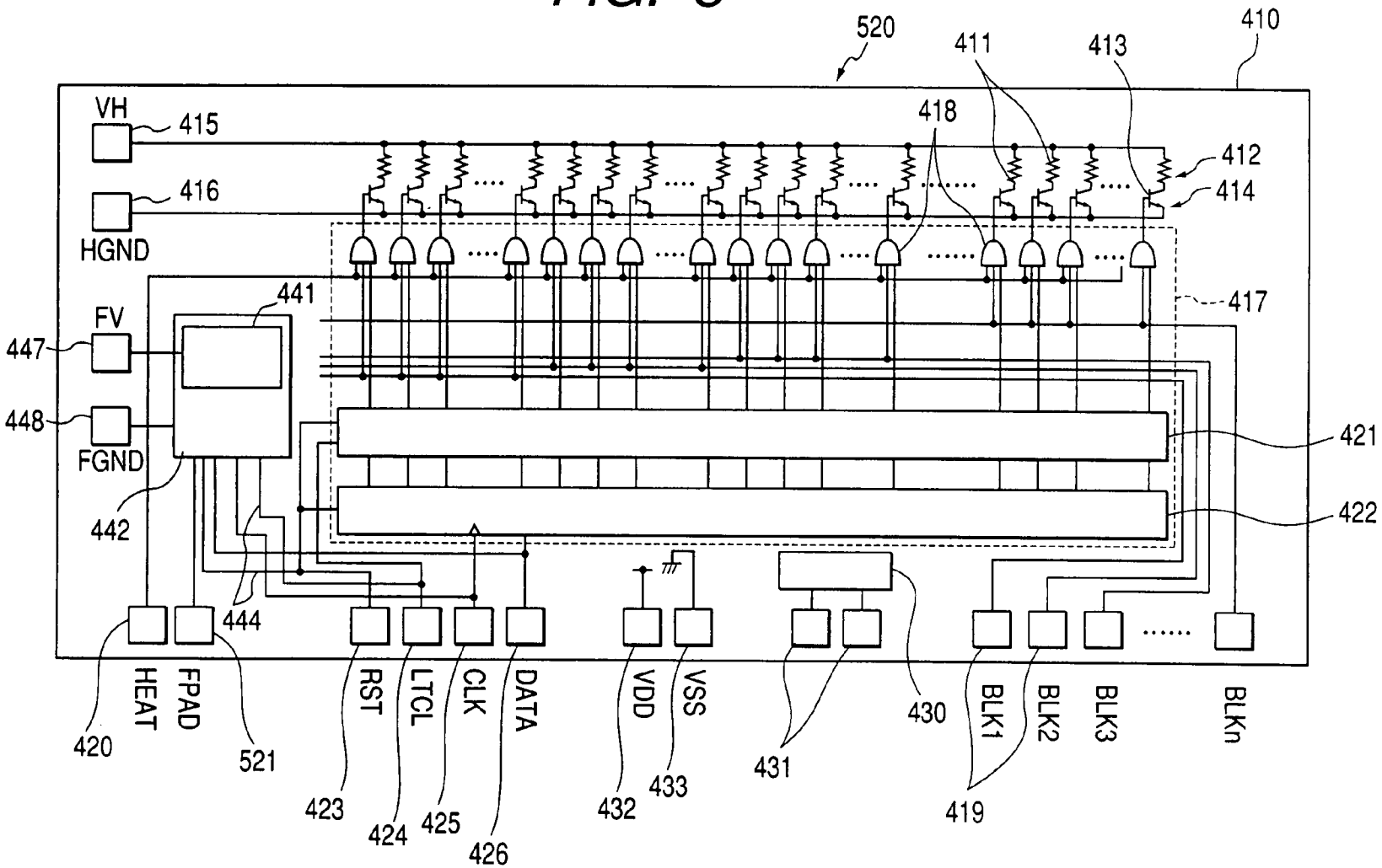
FIG. 8 is a block diagram showing the circuit configuration of a fourth variation of the head substrate.

It is already explained that the mutual erroneous operations do not occur between the recording operation and the memory access in the foregoing embodiment, but, if it is desired to more strictly prevent such erroneous operations, it is preferable, as in the head substrate 520 shown in FIG. 8, to additionally provide an external connection terminal 521 exclusive for externally entering the enable signal for the memory access.

Figure 9:
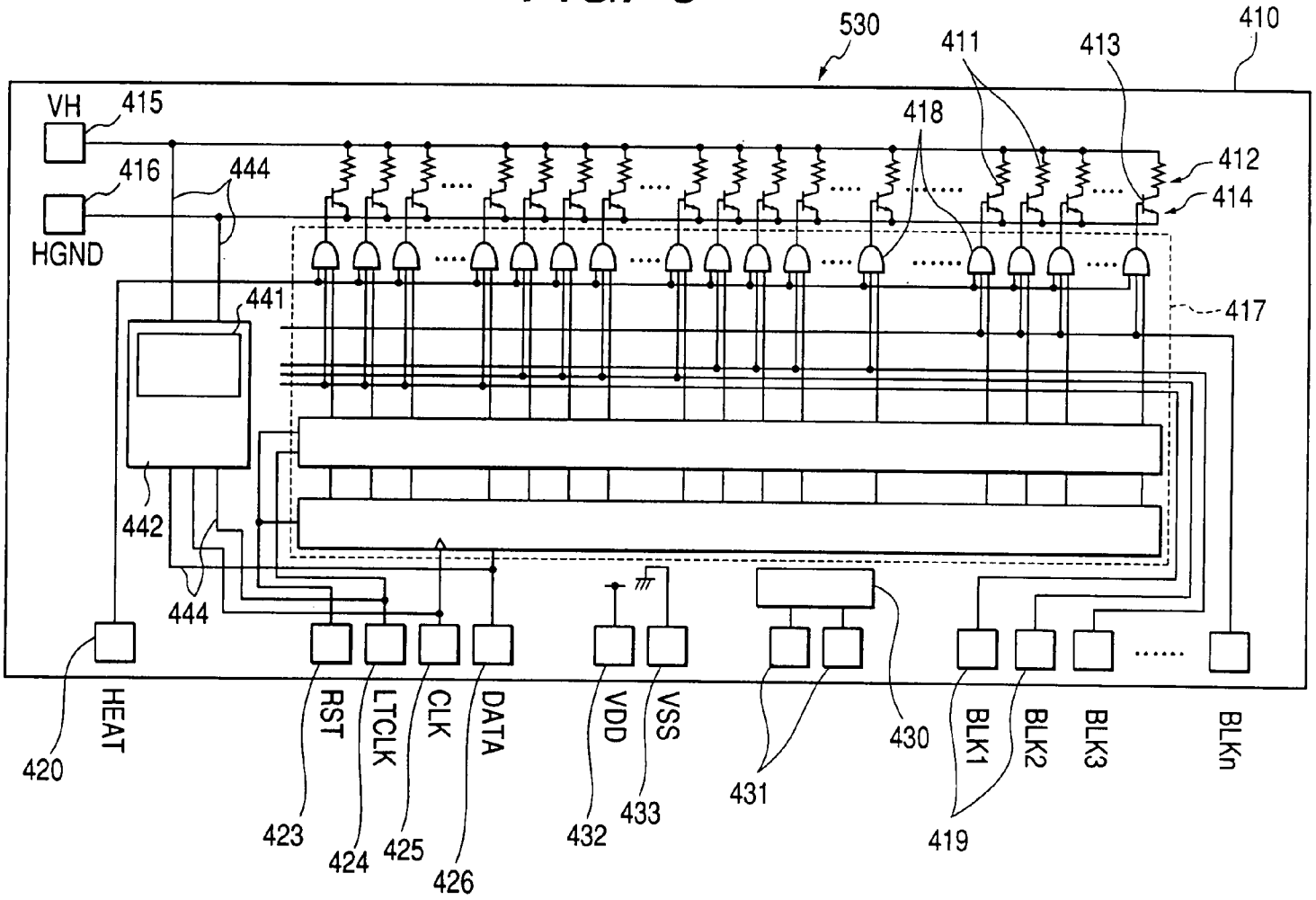
FIG. 9 is a block diagram showing the circuit configuration of a fifth variation of the head substrate.
Figure 10:
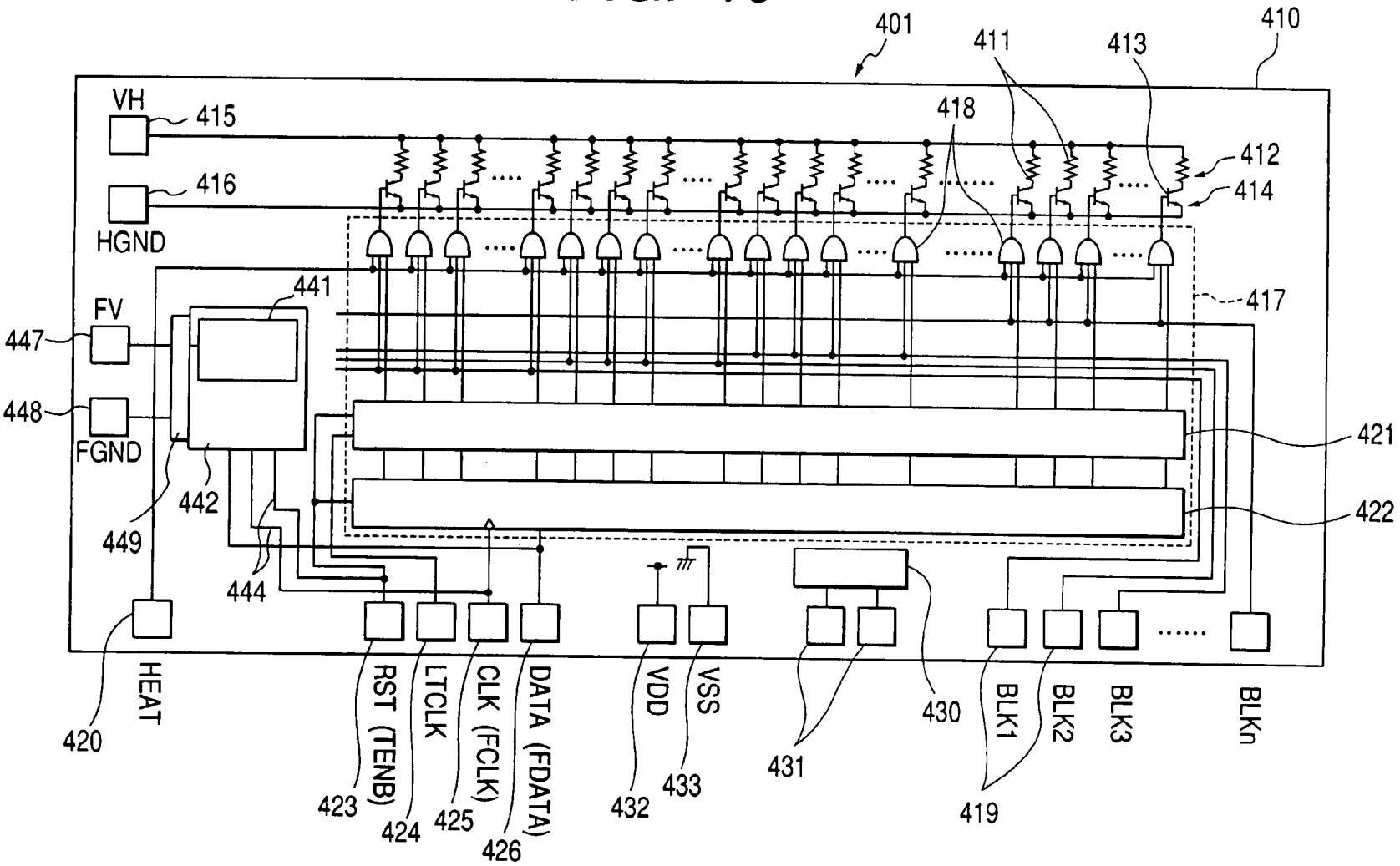
FIG. 10 is a block diagram showing the circuit configuration of a second embodiment of the head substrate of the present invention.

It is also possible, as in the head substrate 530 shown in FIG. 9, to connect the heater power supply terminals 415, 416 for supplying the heater unit 412 with the driving electric power, also to the fuse logic circuit 442, thereby dispensing with the exclusive memory power supply terminals 447, 448 for supplying the fuse logic circuit 442 with the driving electric power.

In such configuration, there are not exclusive external connection terminals connected to the fuse logic circuit 442, so that the printing head and the printer apparatus utilizing a head substrate 530 can be made satisfactorily small and light. It is likewise possible to connect the fuse logic circuit 442 to the power supply terminals 432, 433 thereby dispensing with the heater power supply terminals 415, 416.

Also in the foregoing printing head 400, the presence or absence of the operation of the heater unit 412 is eventually determined by the presence or absence of the recording pulse signal externally entered into the pulse terminal 420, so that it is possible to utilize various signals of the fuse logic circuit 417 for the memory access operation by terminating the recording pulse signal at the execution of the memory access.

In the foregoing embodiment, at the execution of the recording operation, various signals for the recording operation are supplied from the printer main body to the external connection terminals of the head substrate, whereby the recording execution means can execute the recording operation when the recording image signal and the recording clock signal are externally entered in the first state of the binary logic signal. Also at the execution of memory access, various signals for the memory access are supplied from the printer main body to the external connection terminals of the head substrate, whereby the memory access means can execute access to the data memory means in a timing corresponding to the memory clock signal, when the access permission signal is externally entered. Thus, by utilizing a signal which corresponds to whether or not to execute the recording operation and does not vary during the recording operation, among the signals utilized for recording, as the access permission signal and thus switching the memory access operation, it is rendered possible to simplify the logic circuit within the recording head and to reduce the number of the external connection terminals thereof.

Also in the configuration where the common terminal wiring means supplies the memory access means with the binary logic signal entered into the external connection terminal and such memory access means recognizes the binary logic signal of the second state as the access permission signal, there is not required the terminal exclusive for transferring such access permission signal to the memory access means, so that the printing head and the printer apparatus as well as the head substrate can be made smaller and lighter and superior in the production capability.

In the above-described head substrate, the common terminal wiring means serially supplies the memory access means with the input signal at the single external connection terminal, at which the recording image signal is serially entered, as the writing data, thereby realizing input of the recording image signal and the writing data by a single external connection terminal.

In the above-described head substrate, the common terminal wiring means serially supplies an external connection terminal, serially receiving the recording image signal, with the data read from the memory access means, thereby realizing input of the recording image signal and output of the read data by a single external connection terminal.

In the above-described head substrate, the common terminal wiring means supplies the memory access means in parallel with the input signals of plural external connection terminals receiving parallel input of the recording image signal, thereby realizing execution of high-speed input of the recording image signal and the writing data.

In the above-described head substrate, the common terminal wiring means supplies the plural external connection terminals, receiving parallel input of the recording image signal, in parallel manner with data read from the memory access means, thereby realizing high-speed execution of input of the recording image signal and output of the read data.

In the above-described head substrate, the recording execution means is provided with plural recording elements for outputting the recording image signal outputted in parallel from the latch circuit, corresponding to a recording pulse signal externally inputted to a specified one of the external connection terminals, whereby various signals utilized in the recording operation can be utilized for the memory access by terminating the recording pulse signal for the recording elements at the execution of the memory access.

In the above-described head substrate, the common terminal wiring means supplies the memory access means with the recording clock signal of the shift register as the memory clock signal, thereby allowing to utilize an existing signal as the memory clock signal and to simplify the circuit configuration of the printer apparatus.

In the above-described head substrate, the data memory means executes both data writing and data readout as the memory access operation, while the memory access means selectively executes either of data writing and data readout according to an externally entered mode switching signal, and the common terminal wiring means supplies the memory access means with the input signal to a specified one of the external connection terminals, whereby the data memory means can execute both data writing and data readout.

In the above-described head substrate, the recording execution means externally receives the driving electric power from a specified external connection terminal, and the common terminal wiring means supplies the memory access means with the driving electric power for the recording execution means, thereby allowing to dispense with the external connection terminal for supplying the memory access means with the driving electric power and to reduce the dimension and weight of the printing head and the printing apparatus.

In the above-described head substrate, the external connection terminals, recording execution means, data memory means, memory access means and common terminal wiring means are composed of films formed on a base substrate, whereby the printing head can be formed compact and light.

Second Embodiment

In the foregoing embodiment, there has been explained a configuration in which, among the recording signals supplied in the head, a signal corresponding to whether or not to execute the recording operation and not varying during the recording operation is used as the access signal for the memory provided in the head.

In the above-described configuration in which a signal is used in common for the access to the data and for the recording operation, the data stored in the memory may be altered by a noise or the like in the recording operation, but the present embodiment is featured by a fact that the data in the memory of the head are not overwritten even in case a signal is used in common for the recording operation and for the data access.

The recording operation, the memory access operation and the circuit configuration therefor are same as those in the foregoing embodiment and will not, therefore, be explained further.

FIG. 9 shows the circuit configuration of the head substrate of the present embodiment. The recording operation, the memory access operation and the circuit configuration therefor are same as those in the foregoing embodiment and will not, therefore, be explained further.

The fuse logic circuit 442 is also connected to the pair of memory power supply terminals 447, 448 constituting external connection terminals, whereby the driving electric power required for the fuse logic circuit 442 in executing the data writing into the fuse ROM 441 is supplied from such memory power supply terminals 447, 448.

In the present embodiment, however, an electric power fuse 449 constituting writing inhibition means is inserted in the electric power wiring connecting the memory power supply terminals 447, 448 and the fuse logic circuit 442, and the connection between the memory power supply terminals 447, 448 and the fuse logic circuit 442 is cut off by the fused electric power fuse 449 at the shipment of the printing head 400, whereby the data writing by the fuse logic circuit 442, into the fuse ROM 441 is permanently disabled.

In case the external connection terminals for the printing head 400 are used in common for the recording operation and for the memory access, the noise generated at the execution of the recording operation of the ink jet printer may intrude as writing data into the fuse logic circuit 442.

Figure 11:
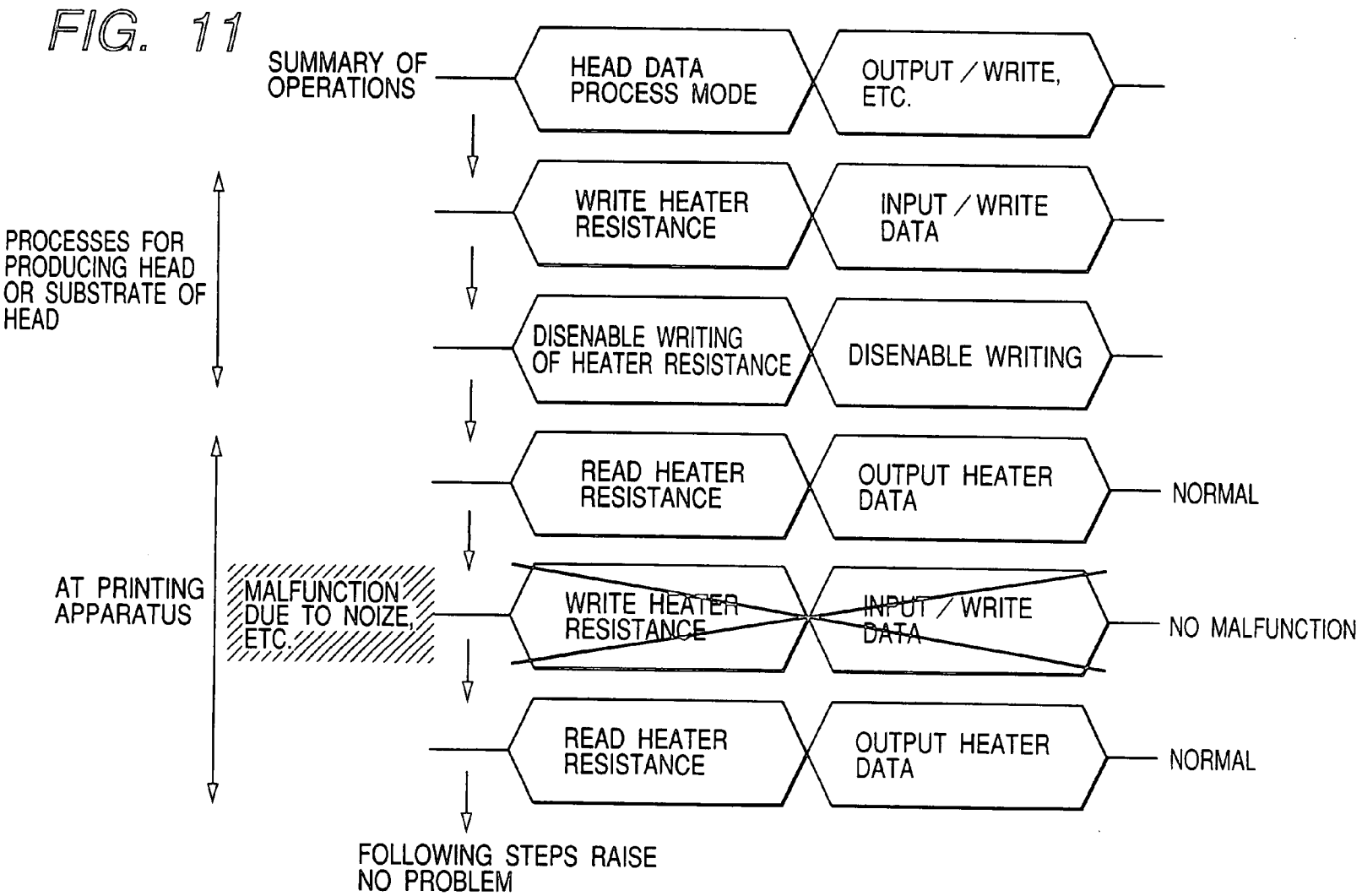
FIG. 11 is a schematic view showing the producing steps for the printing head, together with the state of use of the printer apparatus.

However, in the printing head of the present embodiment, as shown in FIG. 11, various data are written into the fuse ROM 441 by the fuse logic circuit 442 prior to the shipment of the printing head but the electric power fuse 449 is cut off at the shipment thereof.

Therefore, in the printing head 400 shipped as the product, the driving electric power required for data writing cannot be supplied from the memory power supply terminals 447, 448 to the fuse logic circuit 442, so that the data writing by the fuse logic circuit 442 into the fuse ROM 441 is not realized even if a noise is generated in the course of the recording operation.

In FIG. 11, there are shown processes for writing/reading out data representative of a resistance value of the head heater. In the summary of operations, the left represents a preparatory process for conducting each operation and the right represents an operation actually executed at the head side.

As afore-mentioned, in the ink jet printer 300 of the present embodiment, the data stored in the fuse ROM 441 of the printing head 400 cannot be overwritten by the noise, so that the necessary data stored in the fuse ROM 441 cannot be lost and can always be exactly read from the fuse ROM 441.

The substrate described in the present embodiment can naturally be applied to the configuration of the printing head or of the printer apparatus as explained in the foregoing embodiment.

Also, variations relating to the recording operation and the memory access, explained in the foregoing embodiment, are also applicable to the present embodiment.

Figure 12:
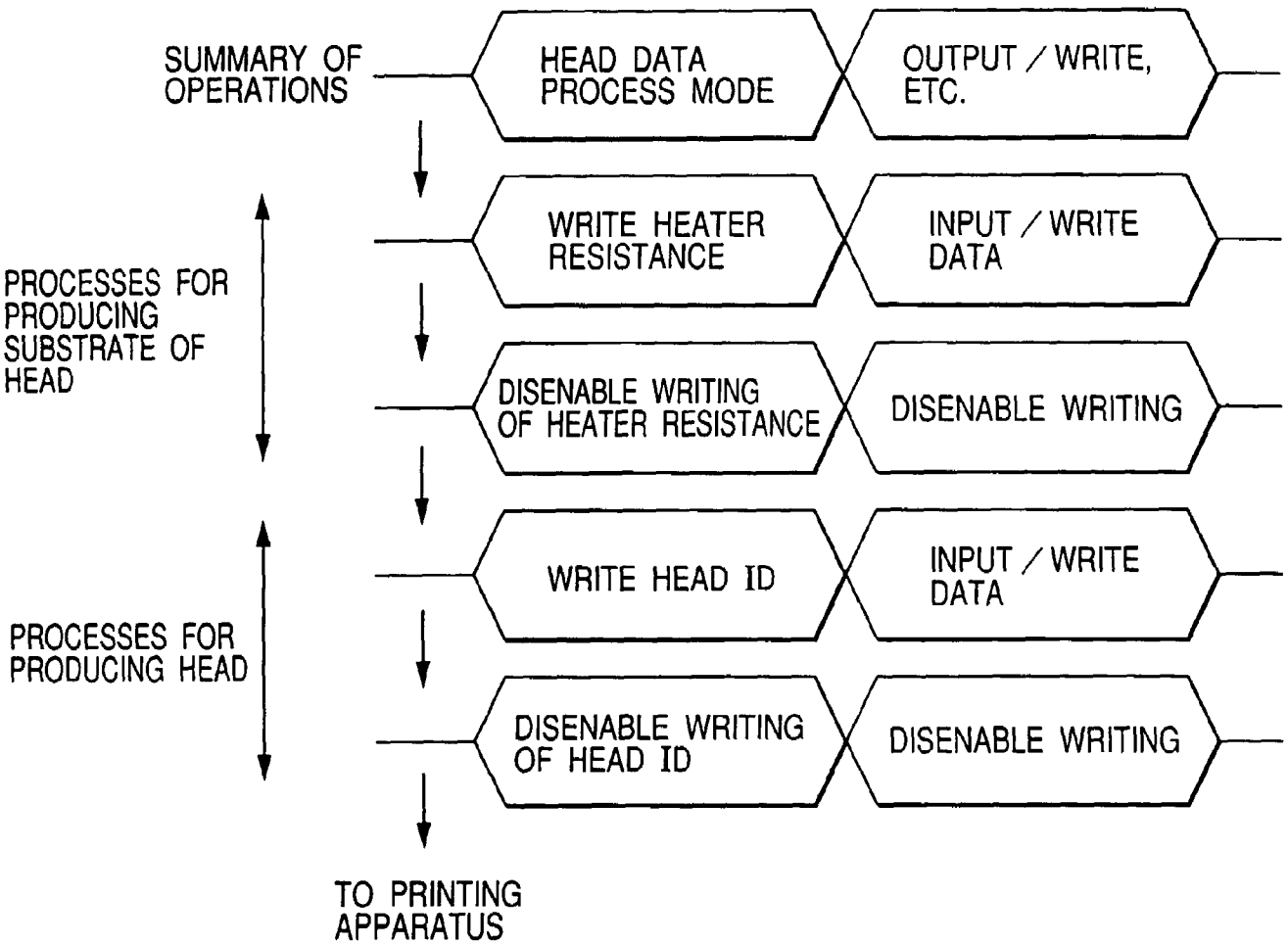
FIG. 12 is a schematic view showing the producing steps for the printing head of a variation, together with the state of use of the printer apparatus.

In the foregoing, it has been explained to write all the necessary data into the fuse ROM 441 and then to disable overwriting of all the data by fusing the electric power fuse 449. It is however also possible, as shown in FIG. 12, to write data of plural kinds in succession into the fuse ROM 441 and to individually disable overwriting of the written data of plural kinds in the order of writing. That is, when producing the head substrate, the writing of the ROM is disenabled after writing the resistance value in the ROM. Then, after producing the head, the writing of the ROM is disenabled after writing the head ID in the ROM. Such configuration can be realized by providing plural fuse ROM's 441 and plural electric power fuses 449.

For example, as shown in FIG. 12, the function characteristics of the heater unit 412 are written and the overwriting is disabled in the fuse ROM 441 at the completion of the head substrate 410, and the head ID is written and the overwriting is disabled at the completion of the printing head 400. In this manner it is possible to write various data at appropriate timings in non-rewritable manner, and the data of the function characteristics cannot be overwritten even if a noise is generated at the writing of the head ID.

Also in the foregoing, it has been explained to cut off the power supply wiring between the fuse logic circuit 442 and the memory power supply terminals 447, 448 by the electric power fuse 449, in order to disable data overwriting of the fuse ROM 441 after the data writing. However, it is also possible to cut off the signal wiring for the access permission signal for data writing, in case the signal wiring for entering the access permission signal to the fuse logic circuit is provided separately for the data writing and for the data readout.

The present embodiment, constructed as explained in the foregoing, further provides the following advantages.

As the data writing into the data memory means by the memory access means is permanently disabled by the writing inhibition means, the data stored in the data memory means cannot be overwritten by a noise, eventually intruding into the memory access means from the external connection terminals in the course of the recording operation, and necessary data cannot be lost and can always be read exactly.

In the above-described head substrate, the writing inhibition means cuts off the electric power wiring for supplying the driving electric power for data writing from the external connection terminals to the memory access means, whereby the data overwriting by the memory access means can be securely prevented as such driving electric power for data writing is not supplied to the memory access means.

In the above-described head substrate, a specified one of the external connection terminals externally receives the access permission signal for permitting the data writing, while the memory access means executes data writing into the data memory means upon externally receiving the access permission signal from the external connection terminal, and the writing inhibition means cuts off the signal wiring for supplying the access permission signal for data writing from the external connection terminal to the memory access means, whereby the data overwriting by the memory access means can be securely prevented since the access permission signal required for data writing is not supplied to the memory access means.

In the above-described head substrate, the memory access means writes data of plural kinds in succession into the data memory means, and the writing inhibition means individually disables the overwriting of the data of plural kinds writing in succession into the data memory means by the memory access means, whereby the data of plural kinds can be written and overwriting can be disabled, at appropriate timings.

In the producing method for the head substrate and the printing head of the present invention, the common terminal wiring means connects the memory access means and the recording execution means to a common external connection terminal, but the data writing into the data memory means by the memory access means is permanently disabled after the completion of data writing into the data memory means by the memory access means, whereby it is rendered possible to produce a head substrate and a printing head in which the necessary data cannot be lost and can always be read exactly, since the data stored in the data memory means are not overwritten by the noise, eventually intruding into the memory access means from the external connection terminal, in case the recording operation is executed by mounting the printing head in the printer apparatus.

In the producing method for the above-described head substrate and printing head, the electric power wiring for supplying the driving electric power for data writing from the external connection terminals to the memory access means in order to permanently disable the data writing into the data memory means by the memory access means, whereby it is rendered possible to provide a head substrate and a printing head in which the data overwriting by the memory access means is securely prevented since the driving electric power required for data writing is not supplied to the memory access means.

In the producing method for the above-described head substrate and printing head, the signal wiring connecting the external connection terminal, externally receiving the access permission signal for permitting the data writing, and the memory access means is cut off in order to permanently disable the data writing into the data memory means by the memory access means, whereby it is rendered possible to provide a head substrate and a printing head in which the data overwriting by the memory access means is securely prevented since the driving electric power required for data writing is not supplied to the memory access means.

What is claimed is:

1. A head substrate of a printing head detachably mounted on a printer main body comprising:

plural external connection terminals individually receiving, from the exterior, a binary logic signal corresponding to whether or not to execute a recording operation, a recording image signal and a clock signal;

recording execution means for executing the recording operation according to the recording image signal and the clock signal entered through said external connection terminals, in case the binary logic signal is in a first state;

data memory means for executing a memory access which is at least either of data writing and data readout; and memory access means for recognizing the binary logic signal as an access permission signal and executing the memory access to said data memory means in case the logic signal is in a second state;

wherein said external connection terminals include:

first common terminal wiring means for supplying the externally entered binary logic signal to said memory access means and to said recording execution means; and second common terminal wiring means for supplying the externally entered clock signal as a recording clock signal to said recording execution means and as a memory clock signal to said memory access means.

2. The head substrate according to claim 1, wherein said recording execution means is adapted for executing the recording operation based on the recording image signal serially entered into one of said external connection terminals; and said common terminal wiring means allows at least one of the input of data into said memory access means and the output of data from said memory access means, using the same external connection terminal that serially inputs the recording image signal.

3. The head substrate according to claim 1, wherein said recording execution means is adapted for executing the recording operation based on the recording image signal parallel entered into plurality of said external connection terminals; and said common terminal wiring means allows at least one of the parallel input of data into said memory access means and the parallel output of data from said memory access means, using the same external connection terminal that inputs, in parallel, the recording image signal.

4. The head substrate according to claim 1, wherein said recording execution means includes a shift register which is reset by a reset signal externally entered into one of said external connection terminals and is adapted to temporarily hold and parallel output, at a timing corresponding to the clock signal, the recording image signal serially entered into another of said external connection terminals; and said common terminal wiring means is adapted for supplying said memory access means with the reset signal for the shift register, as the binary logic signal constituting the access permission signal.

5. The head substrate according to claim 1, wherein said recording execution means includes a shift register which is adapted to be reset by a reset signal externally entered into one of said external connection terminals and then to temporarily hold and parallel output, at a timing corresponding to the clock signal, the recording image signal serially entered into another of said external connection terminals, and a latch circuit which is adapted to be reset by the reset signal and then to temporarily hold and output the recording image signal parallel outputted from the shift register; and said common terminal wiring means is adapted for supplying said memory access means with the reset signal as the binary logic signal constituting the access permission signal.

6. The head substrate according to claim 1, wherein said recording execution means includes a shift register which is adapted to be reset by a reset signal externally entered into one of said external connection terminals and then to temporarily hold and parallel output, at a timing corresponding to the clock signal, the recording image signal serially entered into another of said external connection terminals, and a latch circuit which is adapted to temporarily hold and output the recording image signal parallel outputted from the shift register at a timing corresponding to a latch signal externally entered into still another of said external connection terminals; and said common terminal wiring means is adapted for supplying said memory access means with the latch signal as the binary logic signal constituting the access permission signal.

7. The head substrate according to claim 1, wherein said recording execution means includes plural recording elements for recording the recording image signal parallel outputted from the latch circuit, corresponding to a recording pulse signal externally entered into one of said external connection terminals.

8. The head substrate according to claim 7, wherein the recording element is a heat generating element.

9. The head substrate according to claim 1, wherein said common terminal wiring means is adapted to supply said memory access means with the clock signal for the recording image signal, as a memory clock signal.

10. The head substrate according to claim 1, wherein said data memory means executes both data writing and data readout as the memory access;

said memory access means selectively executes either of data writing into and data readout from said data memory means corresponding to an externally entered mode switching signal; and said common terminal wiring means supplies said memory access means with the input signal to one of said external connection terminals as the mode switching signal.

11. The head substrate according to claim 1, wherein said recording execution means is adapted for receiving a driving electric power externally entered from one of said external connection terminals; and said common terminal wiring means is adapted for supplying said memory access means with the driving electric power for said recording execution means.

12. The head substrate according to claim 1, wherein said external connection terminals, said recording execution means, said data memory means, said memory access means and said common terminal wiring means are constituted by films formed on one base substrate.

13. A printing head detachably mounted on a printer main body, comprising a head substrate according to claim 1.

14. The printing head according to claim 13, wherein the execution means includes heat recording elements for discharging ink.

15. A printing head detachably mounted on a printer main body comprising:

plural external connection terminals individually receiving, from the exterior, a binary logic signal corresponding to whether or not to execute a recording operation, a recording image signal and a clock signal;

recording execution means for executing the recording operation according to the recording image signal and the clock signal entered through said external connection terminals, in case the binary logic signal is in a first state;

data memory means for executing a memory access which is at least either of data writing and data readout; and memory access means for recognizing the binary logic signal as an access permission signal and executing the memory access to said data memory means in case the logic signal is in a second state;

wherein said external connection terminals include:

first common terminal wiring means for supplying the externally entered binary logic signal to said memory access means and to said recording execution means; and second common terminal wiring means for supplying the externally entered clock signal as a recording clock signal to said recording execution means and as a memory clock signal to said memory access means.

16. A printing apparatus comprising:

a printing head detachably mounted on a printer main body comprising a head substrate comprising plural external connection terminals individually receiving, from the exterior, a binary logic signal corresponding to whether or not to execute a recording operation, a recording image signal and a clock signal;

recording execution means for executing the recording operation according to the recording image signal and the clock signal entered through said external connection terminals, in case the binary logic signal is in a first state;

data memory means for executing a memory access which is at least either of data writing and data readout; and memory access means for recognizing the binary logic signal as an access permission signal and executing the memory access to said data memory means in case the logic signal is in a second state;

input means for individually transmitting the binary logic signal of the first state and various signals such as the recording image signal and the clock signal respectively to plurality of said external connection terminals of said printing head, causing said recording execution means to execute a recording operation; and access control means for transmitting the binary logic signal of the second state and the clock signal to said plural external connection terminals of said printing head, causing said memory access means to execute the memory access.

17. The printing apparatus according to claim 16, wherein said input means is adapted for serial transmission of the recording image signal to a specified one of said external connection terminals; and said access control means is adapted for serial transmission of the writing data for said memory access means to one of said external connection terminals in which the recording image signal is serially entered.

18. The printing apparatus according to claim 16, wherein said input means is adapted for parallel transmission of the recording image signal to a specified plurality of said external connection terminals; and said access control means is adapted for parallel transmission of the writing data for said memory access means to said plurality of external connection terminals in which the recording image signal is parallel entered.

19. The printing apparatus according to claim 16, wherein the recording is executed by discharging ink by the heat of a heat generating element.

20. A printing apparatus comprising:

a printing head detachably mounted on a printer main body comprising:

plural external connection terminals individually receiving, from the exterior, a binary logic signal corresponding to whether or not to execute a recording operation, a recording image signal and a clock signal;

recording execution means for executing the recording operation according to the recording image signal and the clock signal entered through said external connection terminals, in case the binary logic signal is in a first state;

data memory means for executing a memory access which is at least either of data writing and data readout; and memory access means for recognizing the binary logical signal as an access permission signal and executing the memory access to said data memory means in case the logical signal is in a second state;

input means for individually transmitting the binary logic signal of the first state and various signals such as the recording image signal and the clock signal respectively to said plurality of external connection terminals of said printing head, causing said recording execution means to execute a recording operation; and access control means for transmitting the binary logic signal of the second state and the clock signal to said plural external connection terminals of said printing head, causing said memory access means to execute the memory access.

21. The printing apparatus according to claim 20, wherein said recording execution means includes a heat generating element for recording.

22. The printing apparatus according to claim 21, wherein the recording is executed by discharging ink by the heat of the heat generating element.

* * * * *

UNITED STATES PATENT AND TRADEMARK OFFICE

CERTIFICATE OF CORRECTION

PATENT NO. : 7,029,081 B1
APPLICATION NO. : 09/426896
DATED : April 18, 2006
INVENTOR(S) : Yoshiyuki Imanaka et al.

It is certified that error appears in the above-identified patent and that said Letters Patent is hereby corrected as shown below:

ON TITLE PAGE AT ITEM (57) ABSTRACT

Line 15, “is” should read --is in--.

IN the DRAWINGS SHEET 11

FIG. 11, “NOIZE,” should read --NOISE,--.

COLUMN 1

Line 36, “interchangeable” should read --interchangeably--; and
Line 62, “utilizing-such” should read --utilizing such--.

COLUMN 5

Line 35, “into” (first occurrence) should be deleted; and
Line 37, “gages” should read --gates--.

COLUMN 6

Line 45, “an” should read --a--

COLUMN 8

Line 16, “generate” should read --generates--.

COLUMN 12

Line 39, “explained” should read --explained how--;
Line 47, “disenabled” should read --disabled--;
Line 49, “disenabled” should read --disabled--; and
Line 61, “explained” should read --explained how--.

UNITED STATES PATENT AND TRADEMARK OFFICE

CERTIFICATE OF CORRECTION

PATENT NO. : 7,029,081 B1
APPLICATION NO. : 09/426896
DATED : April 18, 2006
INVENTOR(S) : Yoshiyuki Imanaka et al.

It is certified that error appears in the above-identified patent and that said Letters Patent is hereby corrected as shown below:

COLUMN 16

Line 37, "comprising" should read --comprising:--.

Signed and Sealed this

Seventeenth Day of October, 2006

JON W. DUDAS
*Director of the United States Patent and Trademark Office*